US011752797B2

(12) United States Patent
Kim

(10) Patent No.: US 11,752,797 B2
(45) Date of Patent: Sep. 12, 2023

(54) DUAL TWIST STRUCTURE, OBJECT EJECTING DEVICE INCLUDING THE SAME, AND STRUCTURE FOR SEALING THE SAME

(71) Applicant: Youb Kim, Siheung-si (KR)

(72) Inventor: Youb Kim, Siheung-si (KR)

( * ) Notice: Subject to any disclaimer, the term of this patent is extended or adjusted under 35 U.S.C. 154(b) by 81 days.

(21) Appl. No.: 17/521,969

(22) Filed: Nov. 9, 2021

(65) Prior Publication Data

US 2022/0227163 A1 Jul. 21, 2022

(30) Foreign Application Priority Data

Jan. 20, 2021 (KR) ..... 10-2021-0007813
Oct. 14, 2021 (KR) ..... 10-2021-0136912
Oct. 14, 2021 (KR) ..... 10-2021-0136917

(51) Int. Cl.
*B43K 24/06* (2006.01)
*B43K 23/12* (2006.01)
*A45D 40/06* (2006.01)

(52) U.S. Cl.
CPC ..... *B43K 24/06* (2013.01); *A45D 40/06* (2013.01); *A45D 40/065* (2013.01); *B43K 23/12* (2013.01)

(58) Field of Classification Search
CPC ..... B43K 24/06; B43K 24/14; B43K 24/143; B43K 24/146; B43K 23/08; B43K 23/12; A45D 40/06; A45D 40/065; A45D 2040/208; A45D 40/205
USPC ..... 401/107, 108, 77, 172–174
See application file for complete search history.

(56) References Cited

U.S. PATENT DOCUMENTS 6,561,711 B1 5/2003 Pierpont
6,588,959 B1 * 7/2003 Kuo ..... A45D 40/065 401/107
2006/0029456 A1 * 2/2006 Liu ..... A45D 40/06 401/107
2009/0162131 A1 6/2009 Thorpe et al.

FOREIGN PATENT DOCUMENTS

GB 2 197 295 A 5/1988
JP 2007-209694 A 8/2007
JP 2009-196374 A 9/2009

(Continued)

OTHER PUBLICATIONS

Extended European Search Report dated Apr. 14, 2022 in European Application No. 21207040.3.

(Continued)

*Primary Examiner* — David J Walczak
(74) *Attorney, Agent, or Firm* — Sughrue Mion, PLLC

(57) ABSTRACT

A dual twist structure, an object ejecting device including the same, and a structure for sealing the same, the dual twist structure including: a housing configured to accommodate a content cartridge therein and having a cam groove provided at a tip thereof; a sleeve coupled to and fitted with the content cartridge and having a cam protrusion formed on an outer portion thereof; and a tubular operation body having a twist cam groove into which the cam protrusion is slidably fitted, and a cam pin protruding and configured to move to a position misaligned with the twist cam groove by being guided by the cam groove, in which the dual twist structure has the two cam grooves.

13 Claims, 15 Drawing Sheets

(56) References Cited

FOREIGN PATENT DOCUMENTS

| | | | |
|---|---|---|---|
| JP | 2018-126963 | A | 8/2018 |
| KR | 10-1995-0000776 | B1 | 2/1995 |
| KR | 10-0772596 | B1 | 11/2007 |
| KR | 10-2054317 | B1 | 12/2019 |

OTHER PUBLICATIONS

Communication (Notice of Reasons for Rejection) dated Aug. 23, 2022 in related Japanese Patent Application No. 2021-185989.

* cited by examiner

[FIG. 1]
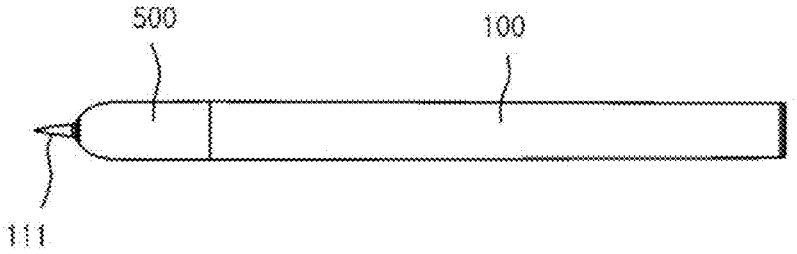

[FIG. 2]
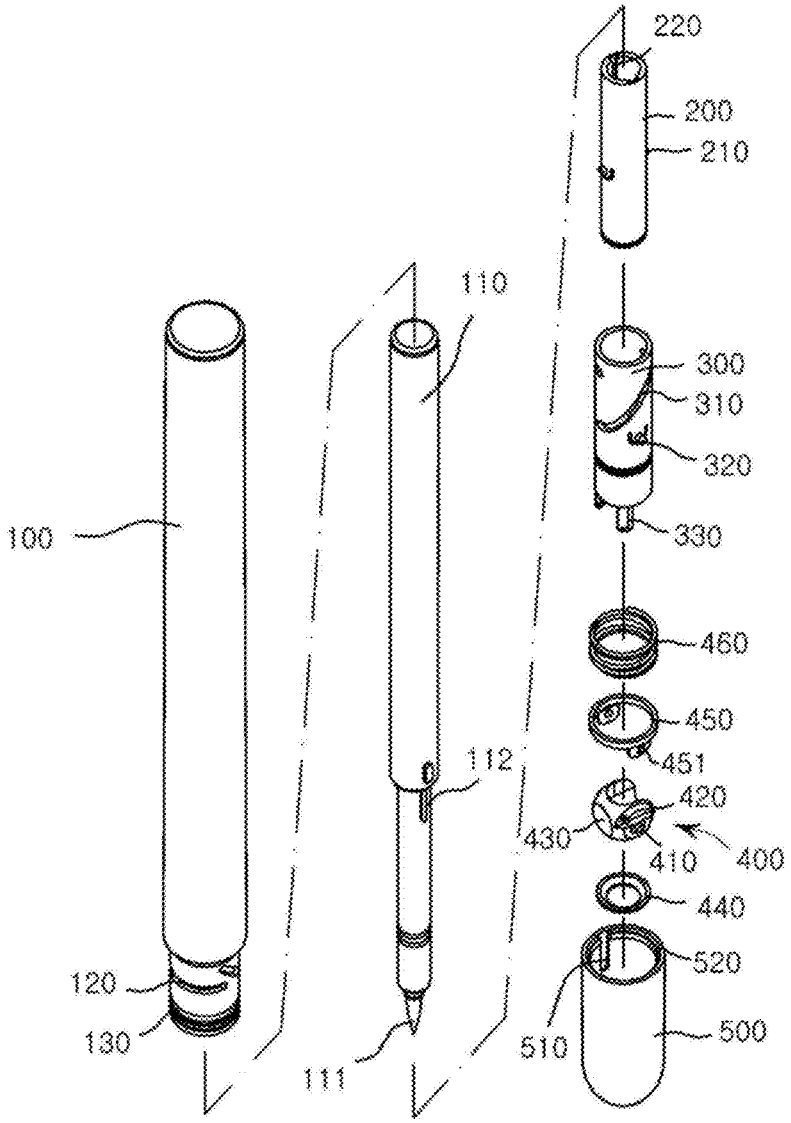

[FIG. 3]
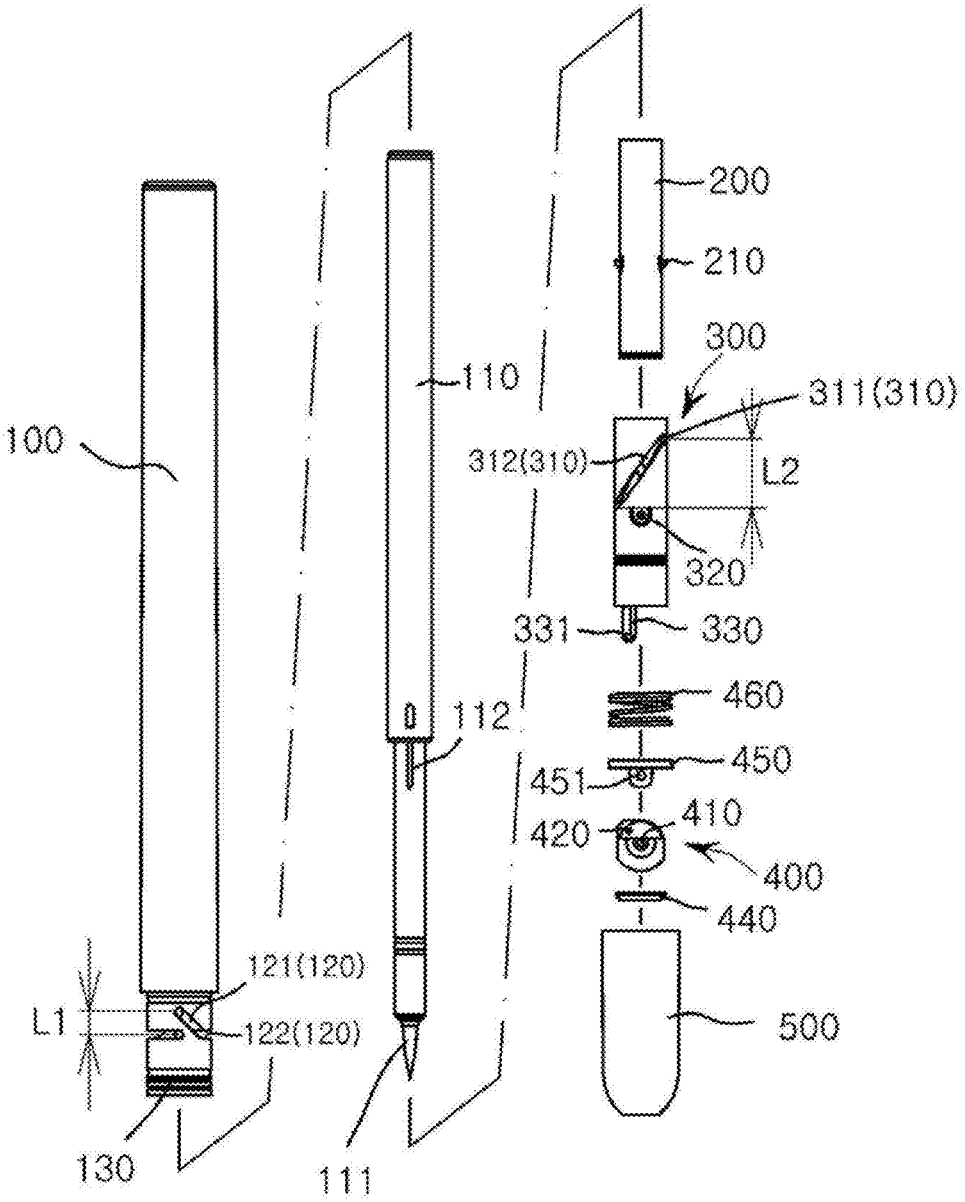

[FIG. 4]
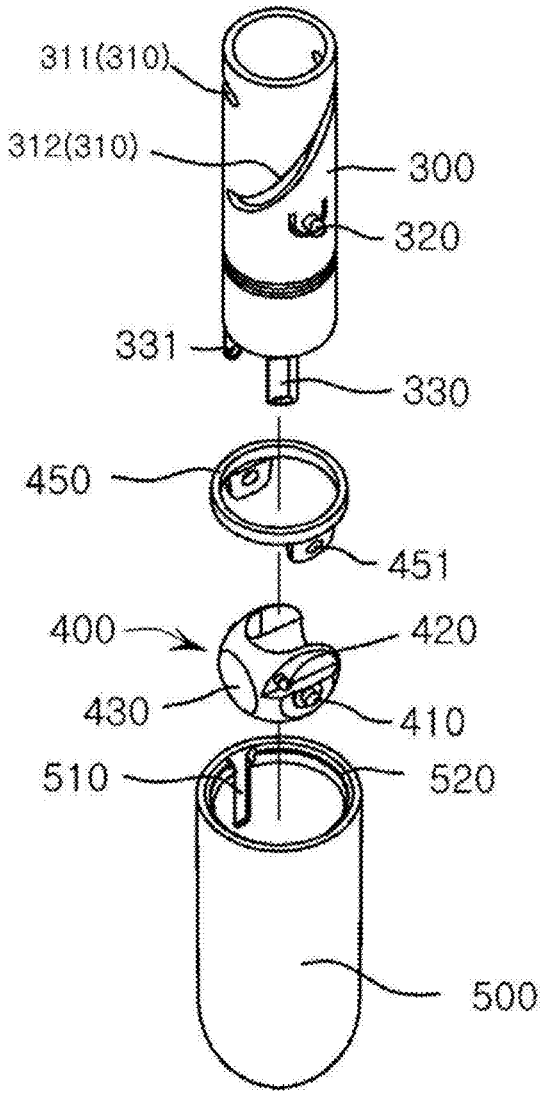

[FIG. 5]
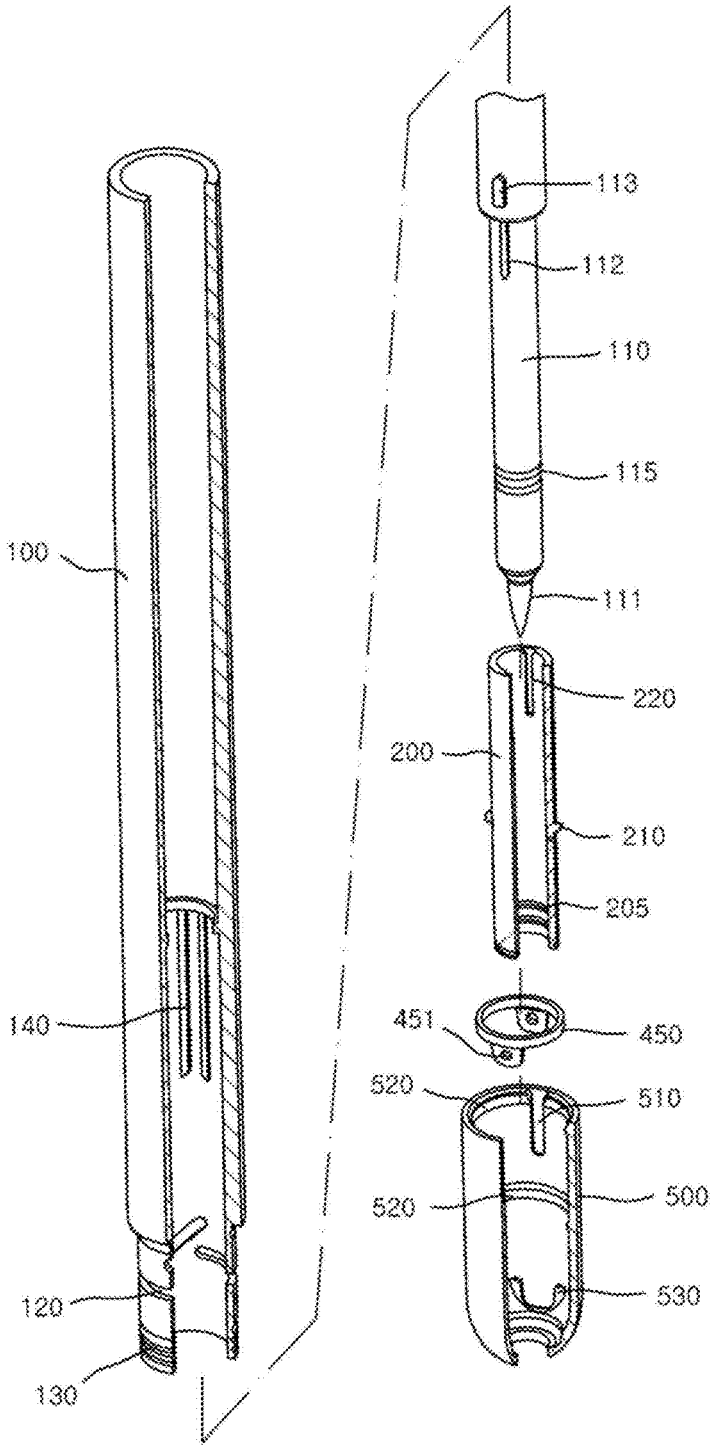

[FIG. 6]
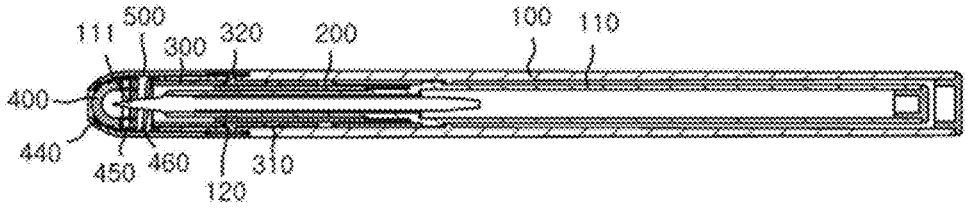
[FIG. 7]
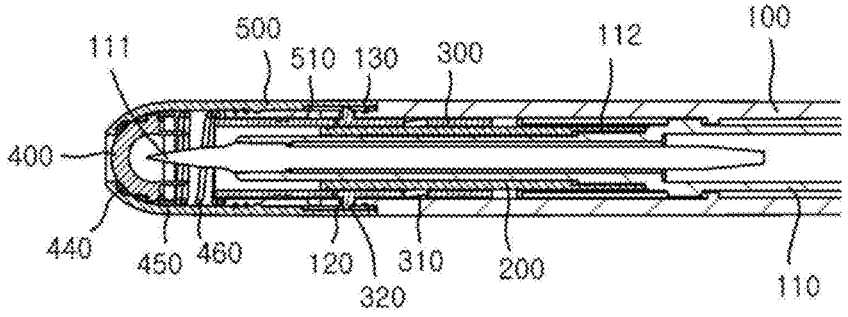
[FIG. 8]
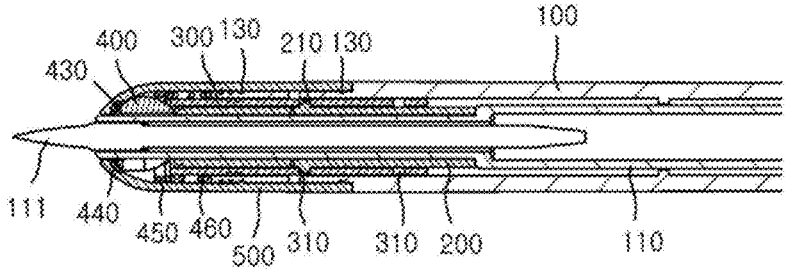

[FIG. 9]
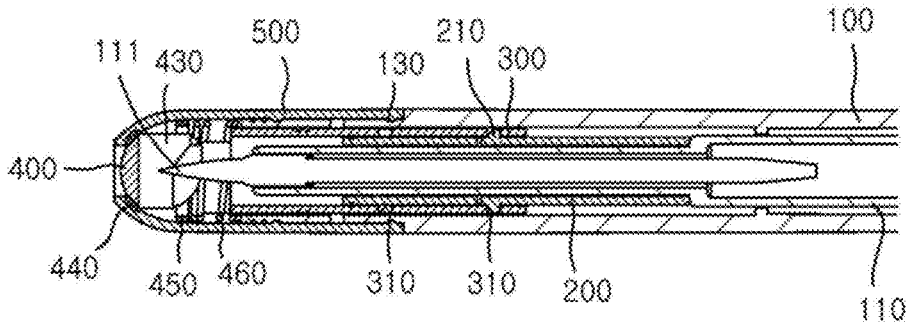
[FIG. 10]
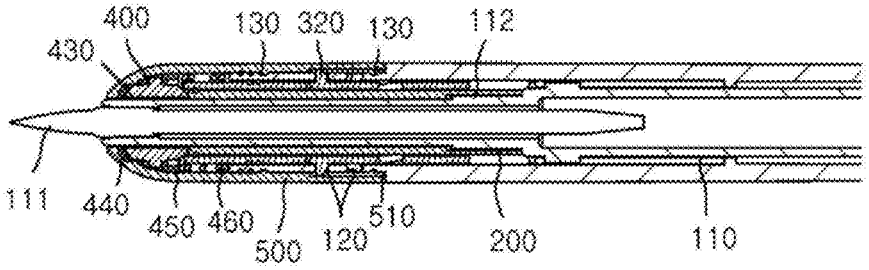
[FIG. 11]
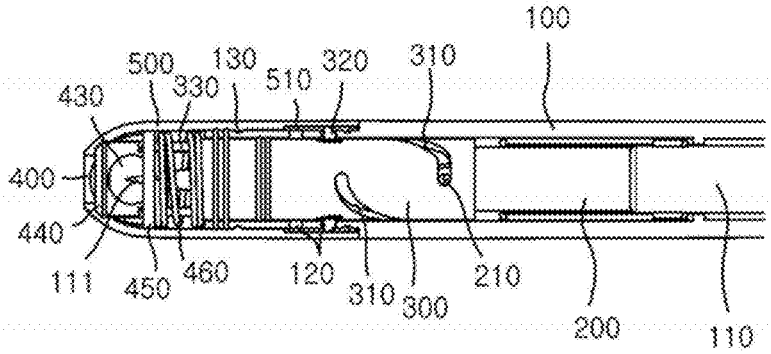

[FIG. 12]
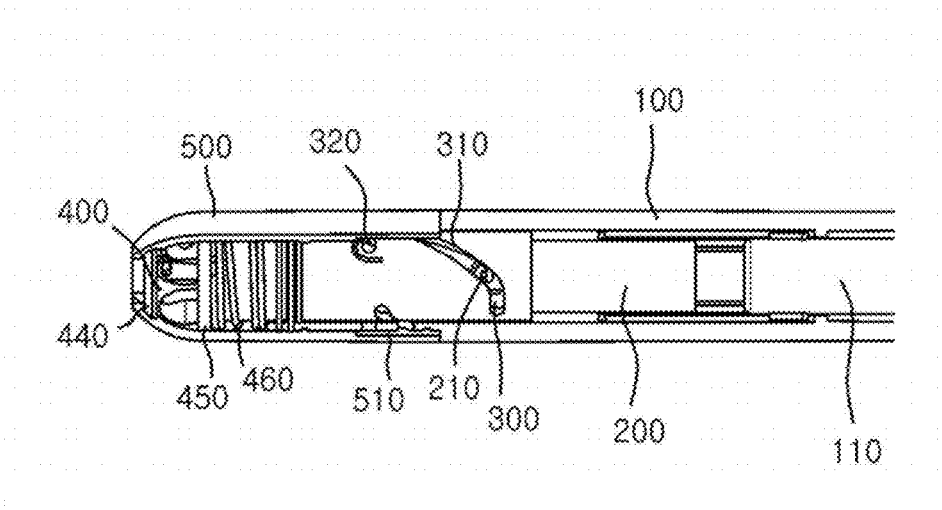
[FIG. 13]
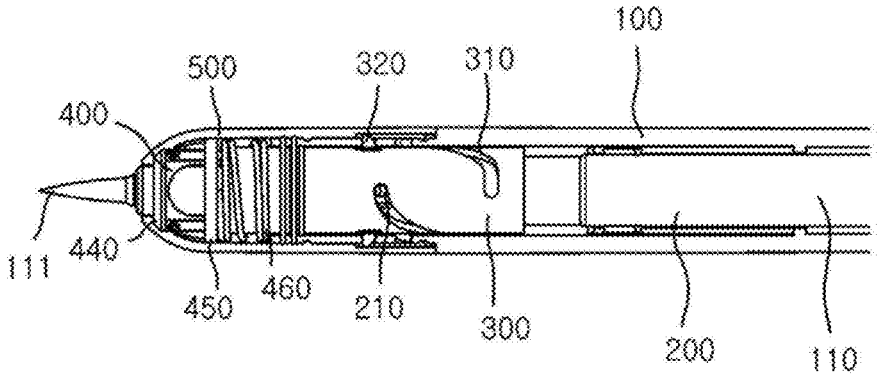

[FIG. 14]
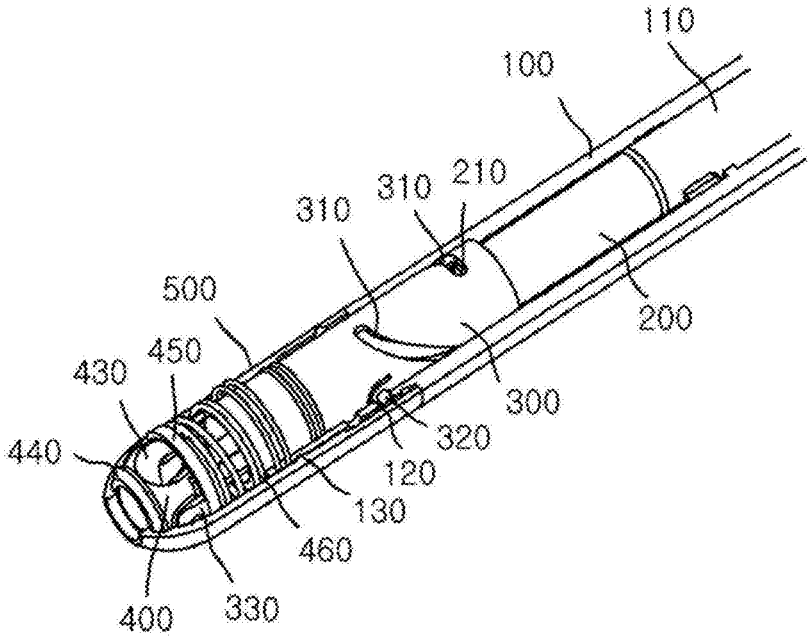
[FIG. 15]
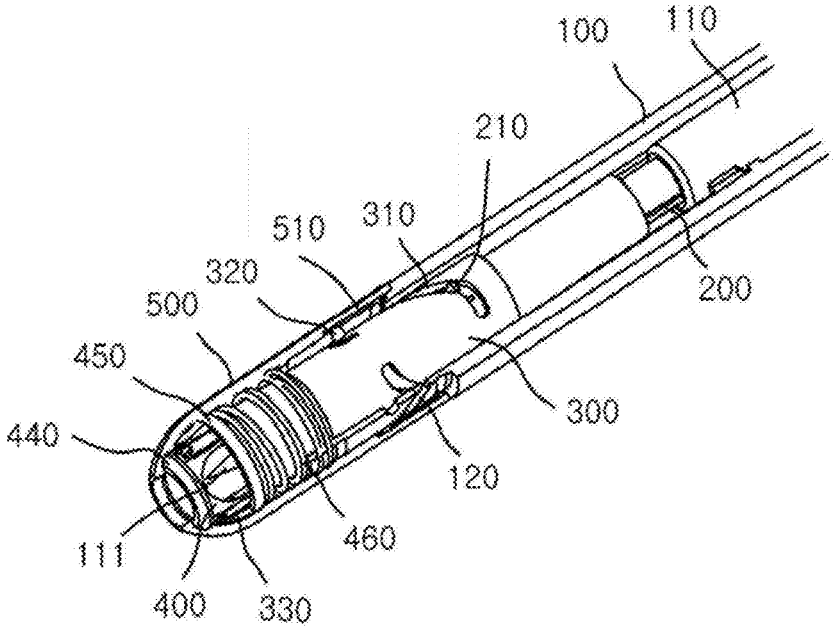

[FIG. 16]
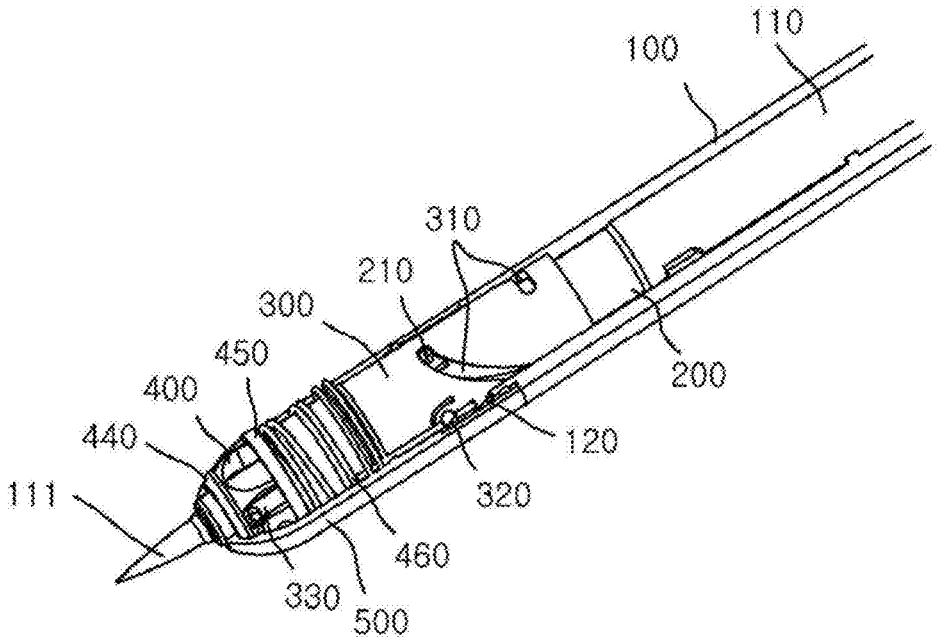
[FIG. 17]
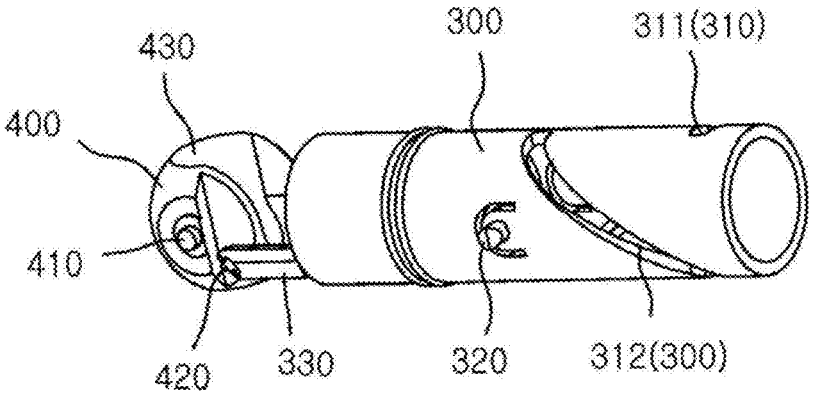

[FIG. 18]
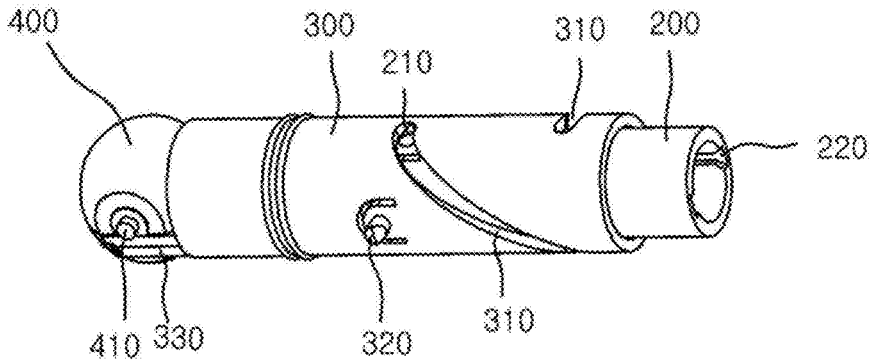
[FIG. 19]
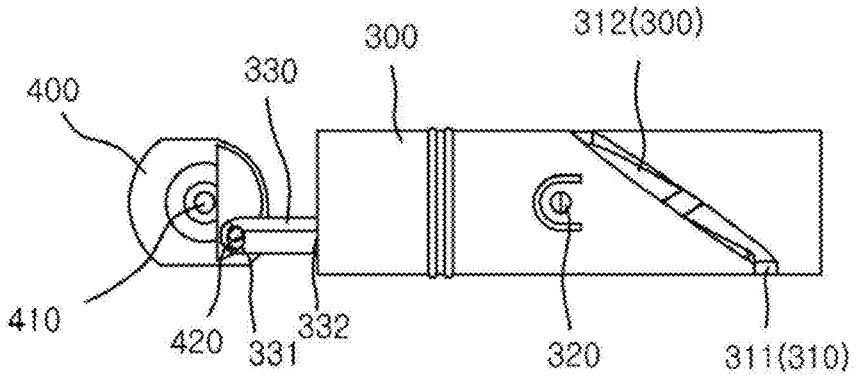

[FIG. 20]
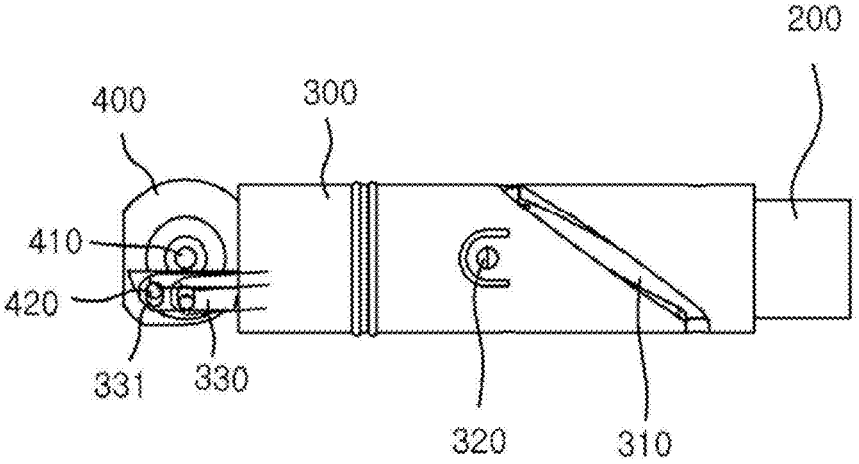

[FIG. 21a]
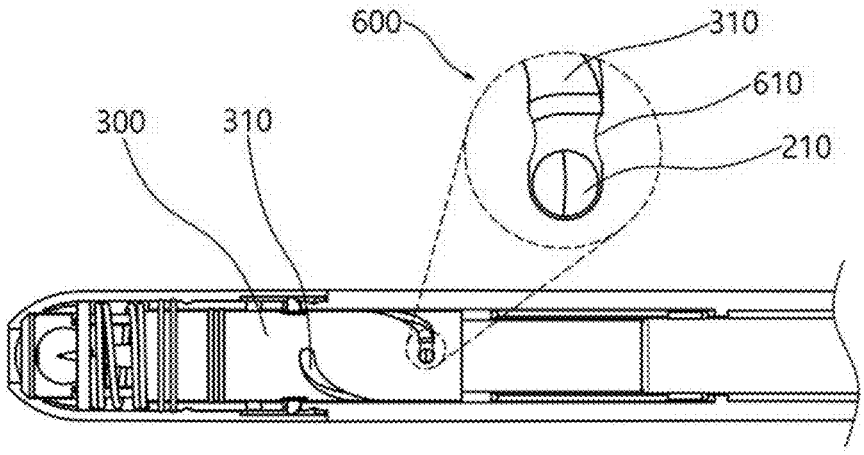
(a)
[FIG. 21b]
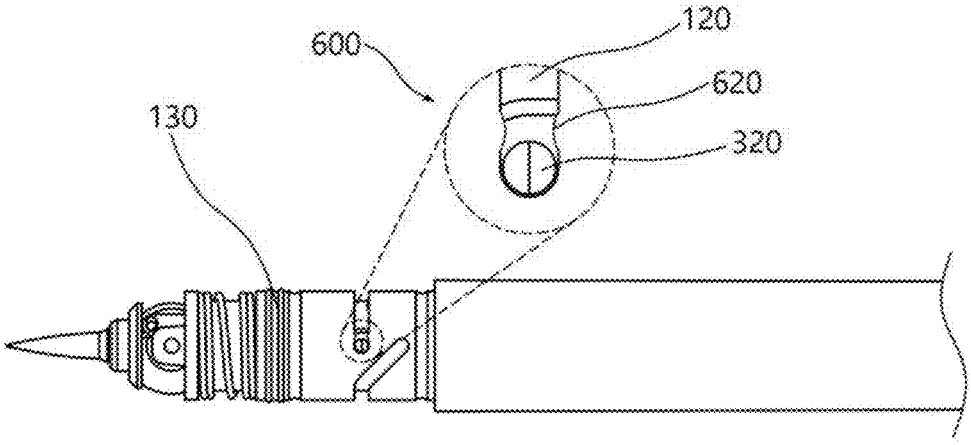
(b)

[FIG. 22a]
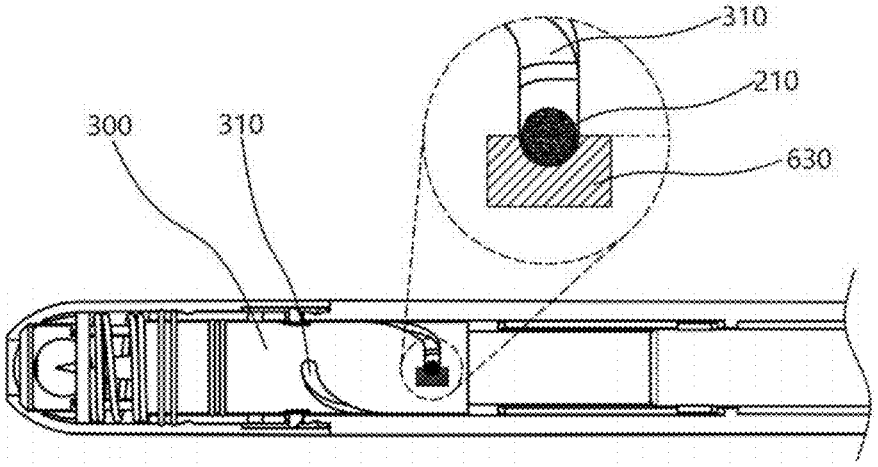
(a)
[FIG. 22b]
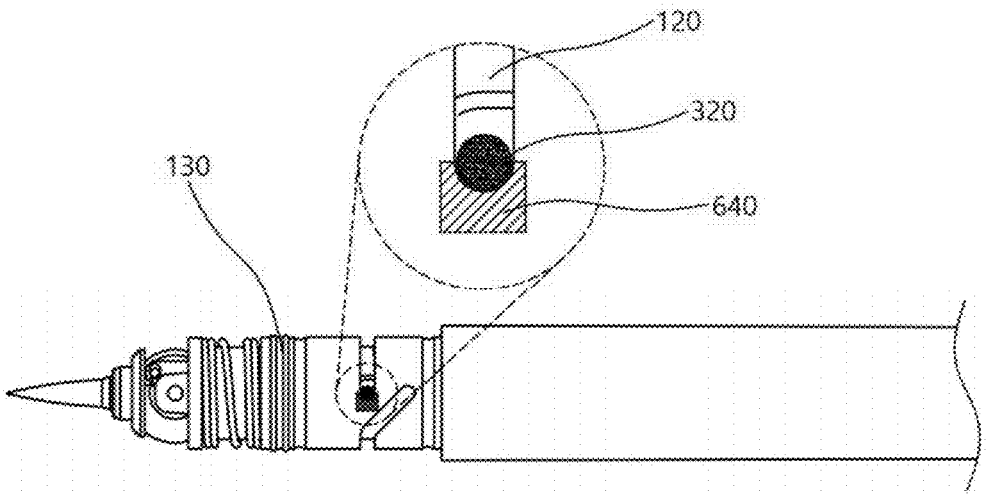
(b)

REPLACEMENT SHEET
[FIG.23]
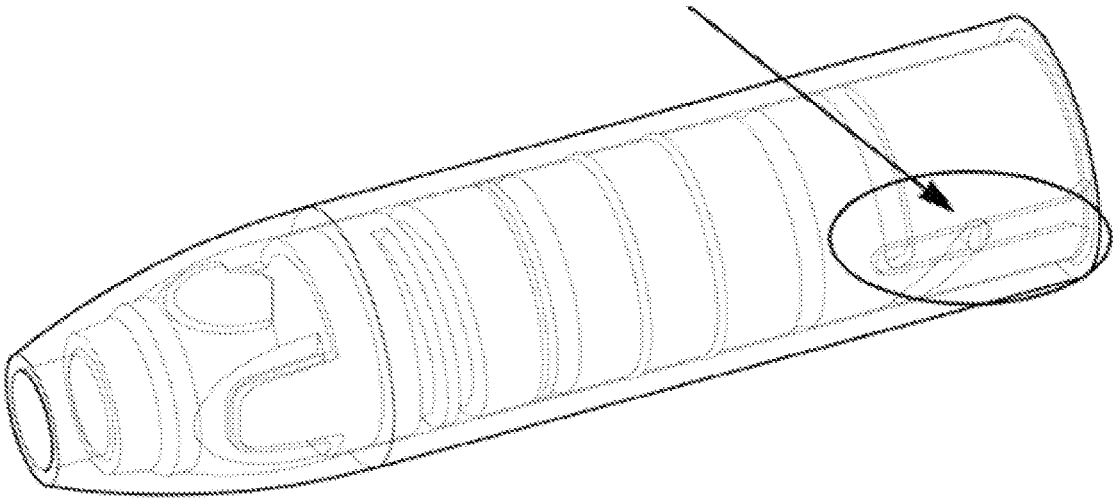
[FIG.24]
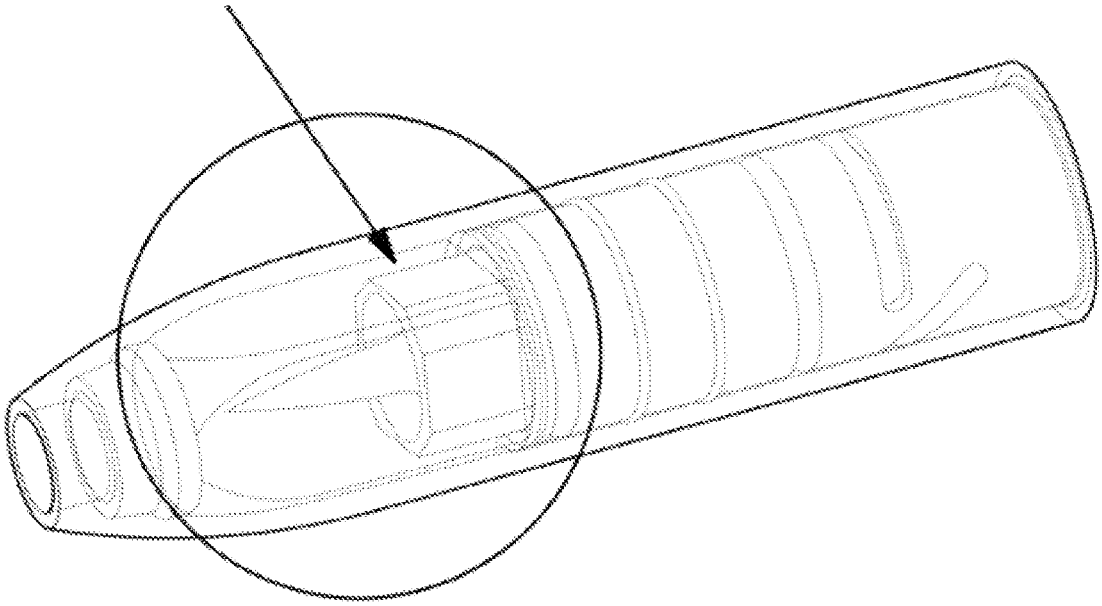

DUAL TWIST STRUCTURE, OBJECT EJECTING DEVICE INCLUDING THE SAME, AND STRUCTURE FOR SEALING THE SAME

CROSS-REFERENCE TO RELATED APPLICATIONS

This application is based on and claims priority from Korean Patent Application No. 10-2021-0007813, filed on Jan. 20, 2021, Korean Patent Application No. 10-2021-0136917, filed on Oct. 14, 2021, Korean Patent Application No. 10-2021-0136912, filed on Oct. 14, 2021, with the Korean Intellectual Property Office, the disclosure of which is incorporated herein in its entirety by reference.

TECHNICAL FIELD

The present disclosure relates to a dual twist structure, an object ejecting device including the same, and a structure for sealing the same, and more particularly, to a dual twist structure capable of improving the convenience of use by allowing a stick cosmetic, a nib of a writing instrument, or a brush stored in a cylindrical long pen type barrel to be extended to the outside of the barrel or retracted into the barrel by simple manipulation. The present disclosure relates to a dual twist structure, which is used to move an object to be ejected by an accurate distance and at an accurate time, an object ejecting device including the same, and a structure for sealing the same.

BACKGROUND

In general, women use various cosmetics to make their appearance more beautiful. For example, color cosmetics are used to make the skin beautiful by making the appearance beautiful.

The color cosmetics are used to make the skin color uniform and cover defects. The color cosmetics are classified into base makeup and point makeup for partially improving a three-dimensional effect of lips, eyes, nails, or the like. The base makeup includes makeup base, foundation, powder, and the like, and the point makeup includes lipstick, eyeliner, mascara, and the like.

Recently, for the purpose of convenience of use and convenience of carriage and storage, a stick cosmetic container has been developed in which a stick cosmetic is mounted at one side of a container, and a user uses the stick cosmetic by raising or lowering the stick cosmetic mounted in the container by rotating the container.

The stick cosmetic container includes a housing, a lower cap having a lifting guide hole formed with a screw thread, an operation member configured to move upward or downward in conjunction with a rotation of the lower cap, an accommodation member coupled to the operation member and attached with the stick cosmetic, a protection tube configured to support the upward or downward movement of the accommodation member and store the stick cosmetic, and an upper cap configured to seal the protection tube.

When the user intends to use the stick cosmetic, the user holds the protection tube with his/her hand and rotates the housing to eject the stick cosmetic from the protection tube or insert the stick cosmetic into the protection tube.

A content ejecting structure of the stick cosmetic container in the related art is configured as a screw structure. However, the user needs to rotate the lower cap and the upper cap multiple times to extend the stick cosmetic container by a desired length in order to use the nib, which causes the user to feel discomfort.

Meanwhile, the writing instruments include ball pens, sign pens, highlighters, magic markers, and the like. Most of the writing instruments have detachably fixed sealing caps, and the sealing cap is used to prevent the tip of the writing instrument from being dried.

The writing instruments are broadly classified into a stationary writing instrument having a fixed pen tip and using a cap (hereinafter, referred to as a 'lid'), a rotary (extendable) writing instrument having a tip that is partially extended to the outside along a spiral pipe as a shaft is partially rotated, a knock-type writing instrument having a spring that moves to extend a pen tip as a shaft is partially pushed, and a retractable (slide type) writing instrument having a pen tip that slides to be extended or retracted.

The retractable writing instrument is advantageous in that the retractable writing instrument may be used without the inconvenience of having to open or close a separate lid. However, because a pen tip hole through which the pen tip is extended or retracted is simply formed at one end of the writing instrument, the retractable writing instrument can be restrictively applied as a writing instrument using a non-volatile or low-volatile material such as oil-based ink.

In contrast, the marker pen, the white pen, the aqueous pen, and the highlighter, which have high volatility, cause the inconvenience of having to open or close the lid. Further, when the pen tip is exposed to the air over a long period of time, the ink or the like is dried up, which shortens or decreases the lifespan of the writing instrument.

Therefore, to solve the above-mentioned problem, Korean Patent No. 10-1995-0000776 (WRITING INSTRUMENT WITH DRYING-PREVENTING MECHANISM AND WITHOUT LID) has been proposed. In this well-known structure, a cover for covering a pen tip is opened by tensile force of a rubber band when a push part of a retractable writing instrument is pushed, and the cover is closed and sealed when the push part is pushed once more, thereby preventing the ink from being dried.

However, because the tensile force of the rubber band is used, the cover is not quickly opened or closed. Further, there is a problem in that durability needs to be improved, and a sealed state of the cover for temporarily closing the hole is very poor.

In addition, Korean Utility Model Registration No. 20-1989-0003644 (WRITING INSTRUMENT WITHOUT CAP) discloses that when a knock part is pushed, a pen tip penetrates an elastic body installed in an inner barrel and is exposed to be used, and when the pen tip returns to an original position as the knock part is released or pushed again, the cut-out portions of the elastic body are sealed by coming into contact with each other to prevent the pen tip from being dried.

However, there are problems in that the friction caused by frequent use may plastically deform the cut-out portion of the elastic body and sealability deteriorates due to the frequent friction.

As a result, the technologies in the related art have a problem in that it is difficult to accurately adjust a movement distance and an operation time of an object to be ejected in accordance with a length of a housing and an operation of an opening port of the housing that accommodates the object to be ejected.

DOCUMENTS OF RELATED ART

Patent Documents (Patent Document 0001) Korean Patent No. 10-772596
(Patent Document 0002) Korean Patent No. 10-2054317

SUMMARY

The present disclosure has been made in an effort to provide a dual twist structure having two cam grooves to eject an object by moving the object by an accurate distance at an accurate time. That is, the present disclosure has been made in an effort to provide a dual twist structure capable of adjusting the time required to open or close an opening port through which an object moves inward or outward and adjusting a movement distance by which the object moves in a housing.

The present disclosure has also been made in an effort to provide an object ejecting device, in which an operation cap is rotated by simple manipulation, contents and a ball valve move in conjunction with each other, and the contents protrude to the outside of a casing or return into the casing, such that the casing is automatically sealed, and thus the contents accommodated in the casing are protected. The present disclosure has also been made in an effort to provide an object ejecting device, in which a stopper and a magnet prevent a rotation of an operation cap, and a user recognizes the rotation of the operation cap to easily check whether the casing is sealed.

The present disclosure has also been made in an effort to provide an object ejecting device capable of preventing a loss of a sealing function or a breakdown even though the object ejecting device is used repeatedly, improving reliability, convenience of use, and marketability of a product, preventing contents to be ejected from being damaged in a casing, preventing substances of the contents from being dried, and storing the contents cleanly.

The objects obtained by the embodiments of the present disclosure are not limited to the aforementioned objects, and other objects, which are not mentioned above, will be clearly understood by those skilled in the art from the following description.

An exemplary embodiment of the present disclosure provides a dual twist structure including: a housing 100 configured to accommodate a content cartridge 110 therein and having a cam groove 120 provided at a tip thereof; a sleeve 200 coupled to and fitted with the content cartridge 110 and having a cam protrusion 210 formed on an outer portion thereof; and a tubular operation body 300 having a twist cam groove 310 into which the cam protrusion 210 is slidably fitted, and a cam pin 320 protruding and configured to move to a position misaligned with the twist cam groove 310 by being guided by the cam groove 120, in which the dual twist structure has the two cam grooves.

In addition, the content cartridge 110 and the sleeve 200 may be integrated.

In addition, the cam groove 120 may include an inclined portion 121 and a straight portion 122 which are capable of adjusting a movement time and a movement distance, and the twist cam groove 310 may include a straight portion 311 and an inclined portion 312 which are capable of adjusting a movement time and a movement distance.

In addition, motion distances of the sleeve 200 and the content cartridge 110 vary depending on inclination angles of the inclined portion 121 and the inclined portion 312.

In addition, a guide protrusion 113 and a guide groove 140 may be respectively provided on the housing 100 and the content cartridge 110 so that the housing 100 and the content cartridge 110 may be in contact with each other and move.

Another exemplary embodiment of the present disclosure provides an object ejecting device including any one of the dual twist structures disclosed in the above-mentioned embodiment of the present disclosure.

In addition, the object ejecting device may include: a ball valve 400 having a ball shape and including: center pins 410 protruding outward from a center position thereof; and eccentric pins 420 protruding from eccentric positions spaced apart from the center pins 410 at a distance and configured to be fitted and assembled with shaft holes 331 of arms 330, and the ball valve 400 may open or close a passageway by controlling a position of a passing hole 430 when the tubular operation body 300 simultaneously rotates in a twist direction and moves forward or rearward by being guided by the cam groove 120; and an operation cap 500 having a guide groove 510 into which the cam pin 320 of the tubular operation body 300 is slidably fitted.

Still another exemplary embodiment of the present disclosure provides an object ejecting device including: a housing 100 having a cylindrical hollow shape for accommodating a content cartridge 110 therein and having a cam groove 120 formed at a tip thereof; a sleeve 200 having a cylindrical hollow shape into which the content cartridge 110 is fitted and coupled and having a cam protrusion 210 formed integrally on an outer portion thereof; a tubular operation body 300 having a twist cam groove 310 into which the cam protrusion 210 of the sleeve 200 is slidably fitted, a cam pin 320 protruding and configured to move to a position misaligned with the twist cam groove 310 by being guided by the cam groove 120 of the housing 100, and arms 330 extending toward the tip portion and having shaft holes 331; a ball valve 400 having a ball shape and including: center pins 410 protruding outward from a center position thereof; and eccentric pins 420 protruding from eccentric positions spaced apart from the center pins 410 at a distance and configured to be fitted and assembled with the shaft holes 331 of the arms 330, in which the ball valve 400 opens or closes a passageway by controlling a position of a passing hole 430 when the tubular operation body 300 simultaneously rotates in a twist direction and moves forward or rearward by being guided by the cam groove 120; and an operation cap 500 having a cylindrical hollow shape and is rotatably coupled to the tip of the housing 100 and having a guide groove 510 into which the cam pin 320 of the tubular operation body 300 is slidably fitted.

In addition, catching grooves 130 may be provided in the tip portion of the housing 100 and catching protrusions 520 caught by the catching grooves 130 may be provided in the operation cap 500 to allow the housing 100 and the operation cap 500 to rotate freely and prevent the separation between the housing 100 and the operation cap 500, a guide protrusion 113 of the content cartridge 110 may be fitted with and assembled to the guide groove 140 recessed in a direction of a center of an axis at a center in the housing 100, and a coupling protrusion 112 may protrude at a position spaced apart from the guide protrusion 113 and be fitted with and coupled to the coupling groove 220 provided in the sleeve 200.

In addition, a ball seat 440 configured to support a rotation of the ball valve 400 may be installed in a tip portion of the operation cap 500, and a support ring 450 may be installed at a position of an installation part 530 of the operation cap 500 so that the center pins 410 of the ball valve 400 are fitted into the pin holes 451, and the ball valve 400 is turned about the center pins 410.

In addition, a spring 460 configured to maintain a pressing force on the ball valve 400 may be installed between the support ring 450 and the housing 100, and a notch groove 332 may be recessed at one end of the arm 330 so that the arm 330 is freely bent.

In addition, the cam groove 120 may include an inclined portion 121 and a straight portion 122, and the twist cam groove 310 may include a straight portion 311 and an inclined portion 312.

Still yet another embodiment of the present disclosure provides an object ejecting device including: a housing 10 having a cam groove 120 provided at a tip thereof, having a guide groove 140 provided therein, and configured to accommodate therein a content cartridge 110 having a guide protrusion 113; a sleeve 200 having a cam protrusion 210 formed integrally with an outer portion thereof and fitted with and coupled to the content cartridge 110; a tubular operation body 300 having a twist cam groove 310 into which the cam protrusion 210 is slidably fitted, a cam pin 320 protruding and configured to move to a position misaligned with the twist cam groove 310 by being guided by the cam groove 120 of the housing 100, and arms 330 extending toward the tip portion and having shaft holes 331; and a ball valve 400 having a ball shape and including: center pins 410 protruding outward from a center position thereof; and eccentric pins 420 protruding from eccentric positions spaced apart from the center pins 410 at a distance and configured to be fitted and assembled with the shaft holes 331 of the arms 330, in which the ball valve 400 opens or closes a passageway by controlling a position of a passing hole 430 when the tubular operation body 300 simultaneously rotates in a twist direction and moves forward or rearward by being guided by the cam groove 120.

In addition, the object ejecting device may further include a fixing unit 600 disposed at one or both of an end of the cam groove 120 and an end of the twist cam groove 310.

In addition, the fixing unit 600 may include a first stopper 610 formed to be convex toward the inside of the cam groove 120 and disposed on at least one of one end and two opposite ends of the cam groove 120, and restrict a movement of the cam pin 320 after the cam pin 320 moves along the cam groove 120 and is fitted with and coupled to the first stopper 610.

In addition, the fixing unit 600 may include a second stopper 620 formed to be convex toward the inside of the twist cam groove 310 and disposed on at least one of one end and two opposite ends of the twist cam groove 310, and restrict a movement of the cam protrusion 210 after the cam protrusion 210 moves along the twist cam groove 310 and fitted with and coupled to the second stopper 620.

In addition, the fixing unit 600 may include a first magnet 630 disposed on at least one of one end and two opposite ends of the cam groove 120, and restrict a movement of the cam pin 320 by means of a magnetic force of the first magnet 630 when the cam pin 320 moves along the cam groove 120.

In addition, the fixing unit 600 may include a second magnet 640 disposed on at least one of one end and two opposite ends of the twist cam groove 310, and restrict a movement of the cam protrusion 210 by means of a magnetic force of the second magnet 640 when the cam protrusion 210 moves along the twist cam groove 310.

In addition, the content cartridge 110 and the sleeve 200 may be integrally manufactured.

In addition, the object ejecting device may include an operation cap 500 rotatably coupled to a tip of the housing 100 and having a guide groove 510 into which the cam pin 320 of the tubular operation body 300 is slidably fitted.

In addition, catching grooves 130 may be provided in the tip portion of the housing 100 and catching protrusions 520 caught by the catching grooves 130 may be provided in the operation cap 500 to allow the housing 100 and the operation cap 500 to rotate freely and prevent the separation between the housing 100 and the operation cap 500, a guide protrusion 113 of the content cartridge 110 may be fitted with and assembled to the guide groove 140 recessed in a direction of a center of an axis at a center in the housing 100, a coupling protrusion 112 may protrude at a position spaced apart from the guide protrusion 113 and be fitted with and coupled to the coupling groove 220 provided in the sleeve 200, a plurality of grooves 115 may be formed in the tip portion of the content cartridge 110, and protrusions 205 may be provided on the sleeve 200 and coupled to the grooves 115.

In addition, a ball seat 440 configured to seal the ball valve 400 may be installed in a tip portion of the operation cap 500, and a support ring 450 may be installed at a position of an installation part 530 of the operation cap 500 so that the center pins 410 of the ball valve 400 are fitted into the pin holes 451, and the ball valve 400 is turned about the center pins 410.

In addition, the support ring 450 may be manufactured integrally with the operation cap 500.

In addition, a spring 460 configured to maintain a pressing force on the ball valve 400 may be installed between the support ring 450 and the housing 100.

In addition, the spring 460 may be manufactured integrally with a tip of the housing 100.

In addition, the cam groove 120 may include an inclined portion 121 and a straight portion 122, and the twist cam groove 310 may include a straight portion 311 and an inclined portion 312.

In addition, a guide protrusion 113 may be provided on the housing 100, and a guide groove 140 may be provided in the content cartridge 110.

In addition, a notch groove 332 may be recessed at one end of the arm 330 so that the arm 330 is freely bent.

Another further embodiment of the present disclosure provides an object ejecting device including: a housing 100 having a cam groove 120 provided at a tip thereof, having a guide groove 140 provided therein, and configured to accommodate therein a content cartridge 110 having a guide protrusion 113; a sleeve 200 fitted with and coupled to the content cartridge 110 and having a cam protrusion 210 formed integrally with an outer portion thereof; and a tubular operation body 300 including: a straight portion 311 and an inclined portion 312; a twist cam groove 310 into which the cam protrusion 210 is slidably fitted; and a cam pin 320 protruding and configured to move to a position misaligned with the twist cam groove 310 by being guided by the cam groove 120.

In addition, the content cartridge 110 and the sleeve 200 may be integrally manufactured.

In addition, a guide groove 140 may be formed in the content cartridge 110, and a guide protrusion 113 may be formed on the housing 100 so as to be in contact with the guide groove 140.

According to the dual twist structure and the object ejecting device according to the present disclosure, the sleeve and the content cartridge simultaneously move when the tubular operation body moves, and the sleeve and the content cartridge further move when the tubular operation body is stopped, such that the motion distances are increased. Therefore, in comparison with the single twist structure, it is possible to increase the motion distance and the operation distance of the content cartridge.

In addition, since the content cartridge is stopped without operating for the operation time for which the ball valve is opened, it is possible to prevent a collision of the nib or the brush. Further, since the nib or the brush operates after the ball valve is opened, it is possible to implement the dual twist structure with the single operation.

In addition, the dual twist structure may be used to accurately adjust the movement distance and the movement time for which the object is extended to the outside of the casing or retracted into the casing as the contents and the ball valve operate in conjunction with the operation cap.

In addition, the operation cap may be rotated by simple manipulation, the contents and the ball valve move in conjunction with each other, and the contents protrude to the outside of the casing or return into the casing, such that the casing is automatically sealed, and thus the contents accommodated in the casing are protected. Further, the stopper and the magnet may prevent the rotation of the operation cap, and the user may recognize the rotation of the operation cap to easily check whether the casing is sealed.

In addition, it is possible to prevent a loss of a sealing function or a breakdown even though the object ejecting device is used repeatedly, improving reliability, convenience of use, and marketability of a product, preventing contents to be ejected from being damaged in a casing, preventing substances of the contents from being dried, and storing the contents cleanly.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

FIG. 1 is a front view illustrating shapes of a dual twist structure, an object ejecting device including the same, and a structure for sealing the same according to an embodiment of the present disclosure.

FIG. 2 is an exploded perspective view of the present disclosure.

FIG. 3 is an exploded perspective view illustrating enlarged main components of the present disclosure.

FIG. 4 is an exploded front view of FIG. 2.

FIG. 5 is an exploded perspective view illustrating the partially cutaway main components of the present disclosure.

FIG. 6 is a cross-sectional view illustrating an entirely assembled state of the present disclosure.

FIG. 7 is a cross-sectional view illustrating the enlarged main components illustrated in FIG. 6.

FIG. 8 is an enlarged cross-sectional view illustrating a state in which an operation cap is rotated and a content cartridge and a nib part are moved forward in a state illustrated in FIG. 6.

FIG. 9 is an enlarged cross-sectional view illustrating a state in which a right-angled part is cut in a state illustrated in FIG. 7.

FIG. 10 is an enlarged cross-sectional view illustrating a state in which the operation cap is rotated and the content cartridge and the nib part are moved forward in a state illustrated in FIG. 7.

FIG. 11 is a view for explaining an internal configuration in which a housing and the operation cap are cut immediately before the operation cap is manipulated.

FIG. 12 is a view for explaining an internal configuration in which the housing and the operation cap are cut in an intermediate operating state when the operation cap is manipulated.

FIG. 13 is a view for explaining an internal configuration in which the housing and the operation cap are cut in a state in which the operation cap is manipulated and the operation is completed.

FIG. 14 is a perspective view illustrating a state illustrated in FIG. 11.

FIG. 15 is a perspective view illustrating a state illustrated in FIG. 12.

FIG. 16 is a perspective view illustrating a state illustrated in FIG. 13.

FIG. 17 is a perspective view illustrating a state in which a tubular operation body and a ball valve are connected and a passing hole of the ball valve is closed.

FIG. 18 is a perspective view illustrating a state in which the tubular operation body and the ball valve are connected, the ball valve is turned, and the passing hole is opened.

FIG. 19 is a front view of FIG. 17.

FIG. 20 is a front view of FIG. 18.

FIGS. 21A and 21B are cross-sectional views illustrating a fixing unit according to another embodiment of the present disclosure.

FIGS. 22A and 22B are cross-sectional views illustrating a fixing unit according to still another embodiment of the present disclosure.

FIGS. 23 and 24 are views illustrating an embodiment of rotational motions of the operation cap and the tubular operation body.

DETAILED DESCRIPTION

In the following detailed description, reference is made to the accompanying drawing, which forms a part hereof. The illustrative embodiments described in the detailed description, drawing, and claims are not meant to be limiting. Other embodiments may be utilized, and other changes may be made, without departing from the spirit or scope of the subject matter presented here.

The objects, other objects, features, and advantages of the present disclosure will be easily understood with reference to the following exemplary embodiments associated with the accompanying drawings. However, the present disclosure is not limited to the exemplary embodiments to be described below and may be specified as other aspects.

For example, a dual twist structure, an object ejecting device including the same, and a structure for sealing the same disclosed in the present disclosure may be sufficiently used not only for cosmetics or writing instruments disclosed in the background art, but also in other fields.

On the contrary, the embodiments introduced herein are provided to make the disclosed content thorough and complete, and sufficiently transfer the spirit of the present disclosure to those skilled in the art.

The exemplary embodiments described and illustrated herein also include complementary exemplary embodiments thereof.

Unless particularly stated otherwise in the present specification, a singular form also includes a plural form. The term "comprise" and/or "comprising" used in the specification does not exclude existence or addition of one or more other constituent elements in addition to the mentioned constituent element.

Hereinafter, the present disclosure will be described in detail with reference to the drawings. To describe the following specific exemplary embodiments, the various particular contents are proposed to more specifically describe the present disclosure and help understand the present disclosure. However, those who are knowledgeable in this field enough to understand the present disclosure may recognize that the present disclosure may be used without the various particular contents. It is noted that the description of the parts, which are commonly known and are not greatly related to the present disclosure, will be omitted in some instances in order to avoid unnecessary confusion when describing the present disclosure.

FIG. 1 is a front view illustrating shapes of a dual twist structure, an object ejecting device including the same, and a structure for sealing the same according to an embodiment of the present disclosure, FIG. 2 is an exploded perspective view of the present disclosure, FIG. 3 is an exploded perspective view illustrating enlarged main components of the present disclosure, FIG. 4 is an exploded front view of FIG. 2, FIG. 5 is an exploded perspective view illustrating the partially cutaway main components of the present disclosure, FIG. 6 is a cross-sectional view illustrating an entirely assembled state of the present disclosure, FIG. 7 is a cross-sectional view illustrating the enlarged main components illustrated in FIG. 6, FIG. 8 is an enlarged cross-sectional view illustrating a state in which an operation cap is rotated and a content cartridge and a nib part are moved forward in a state illustrated in FIG. 6, FIG. 9 is an enlarged cross-sectional view illustrating a state in which a right-angled part is cut in a state illustrated in FIG. 7, FIG. 10 is an enlarged cross-sectional view illustrating a state in which the operation cap is rotated and the content cartridge and the nib part are moved forward in a state illustrated in FIG. 7, FIG. 11 is a view for explaining an internal configuration in which a housing and the operation cap are cut immediately before the operation cap is manipulated, FIG. 12 is a view for explaining an internal configuration in which the housing and the operation cap are cut in an intermediate operating state when the operation cap is manipulated, FIG. 13 is a view for explaining an internal configuration in which the housing and the operation cap are cut in a state in which the operation cap is manipulated and the operation is completed, FIG. 14 is a perspective view illustrating a state illustrated in FIG. 11, FIG. 15 is a perspective view illustrating a state illustrated in FIG. 12, FIG. 16 is a perspective view illustrating a state illustrated in FIG. 13, FIG. 17 is a perspective view illustrating a state in which a tubular operation body and a ball valve are connected and a passing hole of the ball valve is closed, FIG. 18 is a perspective view illustrating a state in which the tubular operation body and the ball valve are connected, the ball valve is turned, and the passing hole is opened, FIG. 19 is a front view of FIG. 17, FIG. 20 is a front view of FIG. 18, FIGS. 21A and 21B are cross-sectional views illustrating a fixing unit according to another embodiment of the present disclosure, and FIGS. 22A and 22B are cross-sectional views illustrating a fixing unit according to still another embodiment of the present disclosure.

As illustrated in FIGS. 1 to 22, the present disclosure relates to a dual twist structure, an object ejecting device including the same, and a structure for sealing the same. The object ejecting device includes a housing 100, a sleeve 200, a tubular operation body 300, a ball valve 400, and an operation cap 500. When the operation cap 500 rotatably installed at a tip of the housing 100 is rotated, the ball valve 400 is opened, and the sleeve and the tubular operation body 300 operate in conjunction with each other, such that a content cartridge 110 accommodated in the housing 100 may be ejected to the outside.

In more detail, a distance by which the tubular operation body 300 is moved by a cam groove 120 is referred to as a first movement distance L1, and a distance by which the content cartridge 110 is moved by a twist cam groove 310 is referred to as a second movement distance L2. When a cam pin 320 of the tubular operation body 300 operates by the first movement distance L1 which is the distance by which the cam pin 320 is moved by an inclined portion 121 of the cam groove 120 provided in the housing 100, a straight portion 311 of the cam groove 310 allows the cam protrusion 210 to rotate by being guided by the straight portion 311 but stop performing the rectilinear motion, i.e., stop rectilinearly moving.

Thereafter, when the cam pin 320 reaches a straight portion 122 of the cam groove 120, the straight portion 122 allows the tubular operation body 300 to continuously rotate but stop performing the rectilinear motion, i.e., stop rectilinearly moving. At this time, the cam protrusion 210 is rotated and rectilinearly moved by an inclined portion 312 of the cam groove 310, such that the cam protrusion 210 may move by the second movement distance L2.

That is, motion distances of the sleeve 200 and the content cartridge 110 vary depending on inclination angles of the inclined portion 121 and the inclined portion 312.

In addition, when the operation cap 500 rotates reversely, the above-mentioned operation is performed in reverse order.

In addition, when the operation cap 500 is rotated, the content cartridge 110 stops moving first when the ball valve 400 is opened by the movement by the first movement distance L1. Then, after the operation cap 500 stops rotating in the state in which the ball valve 400 is opened, the content cartridge 110 moves by the second movement distance L2 and protrudes to the outside of the casing. When the operation cap 500 is rotated reversely, the content cartridge 110 moves by the second movement distance L2 first, and then the operation cap 500 is closed and sealed by the movement by the first movement distance L1.

As a result, according to the present disclosure, when the tubular operation body moves, the sleeve and the content cartridge simultaneously move. The sleeve and the content cartridge further move even though the tubular operation body is stopped, which increases the motion distance. Therefore, in comparison with a single twist structure, the motion distance and the operation distance of the content cartridge are increased. Further, during the operation time for which the ball valve is opened, the content cartridge is stopped without operating, which prevents a collision of a nib or a brush. Further, because the nib or the brush operates after the ball valve is opened, the dual twist structure may be implemented by the single operation.

Meanwhile, in the state in which the ball valve 400 is closed, it is possible to prevent volatile ink for a writing instrument stored in the content cartridge 110 or contents such as a stick cosmetic, which may be discolored or degenerated, from being dried, discolored, and degenerated.

The housing 100 has a cylindrical hollow shape to accommodate therein the content cartridge 110 having a small diameter and a long length and has the cam groove 120 formed at the tip thereof.

The cam protrusion 210 is assembled to the twist cam groove 310 of the tubular operation body 300. When the cam protrusion 210 rotates along a cam curve, the content cartridge 110 and the sleeve 200 may simultaneously move forward or rearward together by the second movement distance L2.

The cam groove 120 has a twisted shape and is provided in singular or plural along a cylindrical portion. The cam groove 120 includes the inclined portion 121 and the straight portion 122.

Therefore, when the operation cap 500 to be described below is rotated in the state in which the cam pin 320 of the tubular operation body 300 is slidably coupled to the cam groove 120, the tubular operation body 300 moves forward or rearward by the first movement distance L1 in the housing 100 while rotating along the inclined surface corresponding to the inclined portion 121.

Further, after the cam pin 320 is moved to the position corresponding to the straight portion 122 of the cam groove 120, the operation cap 500 rotates, but the tubular operation body 300 does not move forward or rearward, even though the operation cap 500 is continuously manipulated.

In addition, the sleeve 200 has a cylindrical hollow shape into which the content cartridge 110 is fitted and coupled, and the cam protrusion 210 integrally protrudes from an outer surface of the sleeve 200.

It is noted that the sleeve 200 may be manufactured separately from the content cartridge 110 or manufactured integrally with the content cartridge 110.

The cam protrusion 210 is assembled to the twist cam groove 310 of the tubular operation body 300. When the cam protrusion 210 rotates along the cam curve, the content cartridge 110 and the sleeve 200 simultaneously move forward or rearward together by the second movement distance L2.

The tubular operation body 300 includes: the twist cam groove 310 into which the cam protrusion 210 of the sleeve 200 is slidably fitted; and the cam pin 320 protruding and configured to move to a position misaligned with the twist cam groove 310 by being guided by the cam groove 120 of the housing 100.

The twist cam groove 310 has a twisted shape and is provided in singular or plural along the cylindrical portion. The twist cam groove 310 includes the straight portion 311 and the inclined portion 312.

Therefore, when the cam protrusion 210 moves along the twist cam groove 310, the cam protrusion 210 cannot move forward in the straight portion 311, but the cam protrusion 210, together with the sleeve 200, may move forward or rearward after the cam protrusion 210 is positioned in the inclined portion 312.

The reason why the straight portion 311 is formed in the twist cam groove 310 as described above is to maintain a time difference between the process of operating the ball valve 400 and the process of opening or closing the passing hole 430, thereby preventing the contact between the ball valve 400 and a nib 111 of the content cartridge 110 that moves forward or rearward together with the sleeve 200.

The cam protrusion 210 of the sleeve 200 is fitted with the inclined portion 312, such that the tubular operation body 300 moves forward or rearward by the second movement distance L2 along the cam curved surface in the housing 100.

In this case, the second movement distance L2 by which the sleeve 200 and the content cartridge 110 move forward or rearward may be relatively longer than the first movement distance L1 provided at the tip of the housing 100. Alternatively, the first movement distance L1 may be relatively longer than the second movement distance L2.

That is, both the cam groove 120 of the housing 100 and the twist cam groove 310 of the tubular operation body 300 each have the twisted shape, and the structure including the cam groove 120 and the twist cam groove 310 may be called the dual twist structure.

More specifically, the dual twist structure means a structure having two cam grooves that convert a rotational motion into a rectilinear motion, thereby moving the object by an appropriate distance and at an accurate time when ejecting the object, such that an end of the object accurately passes through an opening port.

More specifically, the dual twist structure includes the cam groove 120 of the housing 100 and the twist cam groove 310 of the tubular operation body 300.

Meanwhile, the guide groove 140 is formed at a center in the housing 100 in a direction of a center of an axis, i.e., a direction in which the content cartridge 110 is ejected. As the guide protrusion 113 protruding from the content cartridge 110 is assembled by being fitted into the guide groove 140, the sleeve 200 and the content cartridge 110 cannot rotate but can move forward or rearward only in the rectilinear direction.

Further, the coupling protrusion 112 protrudes at a position spaced apart from the guide protrusion 113 and is coupled and fitted into the coupling groove 220 provided in the sleeve 200.

In addition, a single groove 115 or a plurality of grooves 115 is formed in a tip portion of the content cartridge 110, and a single protrusion 205 or a plurality of protrusions 205 configured to be coupled to the groove 115 is formed on the sleeve 200. Therefore, the content cartridge 110 and the sleeve 200 are tightly assembled and sealed so as not to separate from each other or move unintentionally.

In addition, according to another embodiment, the guide protrusion 113 may be formed at the center in the housing 100, and the guide groove 140 capable of accommodating the guide protrusion 113 may be formed in the content cartridge 110.

A pair of arms 330 extends from the tubular operation body 300 toward the tip portion and each has shaft holes 331.

The arms 330 serve to turn the ball valve 400.

The ball valve 400 has a ball shape and includes center pins 410 protruding outward from two opposite sides of a center position thereof.

Further, eccentric pins 420 protrude at eccentric positions spaced apart from the center pins 410 at a distance.

The eccentric pin 420 is assembled by being fitted into the shaft hole 331 of the arm 330.

Further, the passing hole 430 is formed in the ball valve 400 and disposed at a position at which the arms 330 are maximally moved to the tip of the ball valve 400 so that the nib 111 of the content cartridge 110 may pass through the passing hole 430.

Therefore, when the arms 330 move forward or rearward together with the tubular operation body 300, the ball valve 400 controls the position of the passing hole 430 by turning the eccentric pins 420 at the exact position about the center pins 410, thereby opening or closing the passageway.

The tubular operation body 300 simultaneously rotates in the twist direction and moves forward or rearward by being guided by the cam groove 120 provided in the housing 100.

The operation cap 500 is installed on the tip portion of the housing 100 to manipulate the tubular operation body 300 and the sleeve 200.

The operation cap 500 has a cylindrical hollow shape and is rotatably coupled to the tip of the housing 100. The operation cap 500 has a guide groove 510 into which the cam pin 320 of the tubular operation body 300 is slidably fitted.

Meanwhile, as illustrated in FIGS. 23 and 24, the operation cap serves as a guide that moves the tubular operation body while rotating the tubular operation body. An embodiment in which the tubular operation body is operated and moved forward in another manner may be applied to the present disclosure in addition to the embodiment in which the cam pin of the tubular operation body is operated by being fitted into the guide groove of the operation cap (a sealing structure having a rotary ball).

Meanwhile, to allow the housing 100 and the operation cap 500 to freely rotate and prevent the separation between the housing 100 and the operation cap 500, a catching groove 130 is formed in the housing 100, and a catching protrusion 520, which is caught by the catching groove 130, is formed on the operation cap 500.

It is advantageous in preventing the separation that the catching grooves 130 and the catching protrusions 520 are respectively installed at a plurality of positions while maintaining distances therebetween.

Therefore, the operation cap 500 does not separate from the housing 100 even though the operation cap 500 is turned.

Further, a ball seat 440 made of an elastic material is installed inside the tip portion of the operation cap 500 and supports the rotation of the ball valve 400, thereby sealing the ball valve 400.

In addition, a support ring 450 is installed to allow the ball valve 400 to be turned about the center pins 410 in the state in which the center pins 410 of the ball valve 400 are fitted into the pin holes 451. A spring 460 for maintaining elasticity is installed between the support ring 450 and the housing 100.

In this case, it is noted that the support ring 450 may be manufactured integrally with the operation cap 500 to reduce the manufacturing process and the manufacturing costs.

The spring 460 presses the ball valve 400 connected to the support ring 450 so that the ball valve 400 is in close contact with the ball seat 440, such that a gap is prevented from being formed at the periphery of the ball valve 400, thereby maintaining an effect of perfectly sealing the inside of the housing 100.

In this case, the spring 460 and the housing 100 may be independently manufactured. However, the spring 460 may be manufactured integrally with the tip of the housing 100.

In this case, the spring 460 and the housing 100 may be made of a single material having elasticity, thereby reducing the manufacturing process and the manufacturing costs and improving the economic effect.

An installation part 530 is provided inside the tip portion of the operation cap 500, and the support ring 450 is seated on the installation part 530 and prevented from being moved unintentionally.

In addition, a notch groove 332 is formed at an inner end of each of the arms 330 so that the arms 330 are freely bent. Therefore, the ball valve 400 may smoothly move even in an upward/downward direction during the process in which the ball valve 400 turns the eccentric pins 420 about the center pins 410 as the arms 330 move forward or rearward.

The nib 111, a brush, or the like is installed at the tip of the content cartridge 110 structured as described above, such that the content cartridge 110 may be configured as an ink container for a writing instrument.

In addition, the nib 111 disclosed in the present specification means a pen point. Further, the nib 111 may mean a component capable of transmitting the contents, stored in the content cartridge 110, to the outside of the object ejecting device. In addition, the nip 111 may be provided in the form of a brush, a simple opening, a tube, or the like.

Alternatively, it is noted that the content cartridge 110 may be configured as a container that accommodates stick cosmetic contents.

FIG. 6 is a cross-sectional view illustrating a state in which the respective components of the present disclosure are assembled, and FIG. 7 is an enlarged view of FIG. 6, which illustrates a state in which the content cartridge 110 and the nib 111 are accommodated and stored in the housing 100.

FIG. 8 illustrates a state in which the content cartridge 110 and the nib 111 are exposed to the outside of the housing 100 and used in a state in which the operation cap 500 is rotated by about 180 degrees and the passing hole 430 of the ball valve 400 is opened.

In this case, it is noted that the operation cap 500 may be rotated within a range of angle, which is not predetermined, depending on the field to which the object ejecting device is applied.

When the operation cap 500 rotatably coupled to the tip portion of the housing 100 is turned, the rotational force is transmitted to the tubular operation body 300 in the state in which the cam pin 320 is caught by the guide groove 510, and the tubular operation body 300 moves forward by the first movement distance L1 while rotating by being guided by the inclined portion 121 of the cam groove 120 provided in the housing 100.

Further, even though the operation cap 500 continuously rotates, the cam pin 320 moves along the straight portion 122, such that the tubular operation body 300 stops rectilinearly moving and only rotates at the same position.

At the same time, the sleeve 200 and the content cartridge 110 operate together along the twist cam groove 310 provided in the tubular operation body 300.

First, during the process in which the tubular operation body 300 moves forward while rotating, the cam protrusion 210 is positioned in the straight portion 311 of the twist cam groove 310. Therefore, the sleeve 200 and the content cartridge 110 coupled to the sleeve 200 move together by a distance equal to the movement distance of the tubular operation body 300.

In this case, the continuous movement of the tubular operation body 300 turns the ball valve 400. At the moment when the cam protrusion 210 is positioned at the position on the inclined portion 312 connected to the straight portion 311, the content cartridge 110 coupled to the sleeve 200 quickly moves forward by the second movement distance L2.

That is, in the state in which the guide groove 140 of the housing 100 prevents the guide protrusion 113 from rotating, the content cartridge 110 further rectilinearly moves forward by the second movement distance L2 defined by the inclined portion 312.

In this case, the second movement distance L2 is relatively longer than the first movement distance L1, and the movement distance of the content cartridge 110 coupled to the sleeve 200 is relatively long, such that the nib 111 may be sufficiently exposed to the outside of the operation cap 500.

The guide groove 510 provided in the operation cap 500 is recessed to have a sufficient length in consideration of the distance by which the cam pin 320 moves. The guide groove 510 guides the rectilinear movement while preventing the separation when the cam pin 320 rotates.

The arms 330 extending toward the tip portion of the tubular operation body 300 move forward or rearward in the state in which the eccentric pins 420 of the ball valve 400 are fitted with and assembled to the shaft holes 331, such that the arms 330 may turn the ball valve 400 and shift the position of the passing hole 430 to open or close the passing hole 430 (see FIGS. 8 and 10).

In addition, when the operation cap 500 is rotated to the original position, the sleeve 200 and the content cartridge 110 begin to be retracted first in reverse order by being guided by the inclined portion 312, and the operation of the tubular operation body 300 shifting the position of the passing hole 430 of the ball valve 400 cannot be performed by the straight portion 122 of the cam groove 120 formed in the housing 100.

Further, from the moment when the cam pin 320 is positioned in the inclined portion 121, the tubular operation body 300, together with the arms 330, is retracted, the ball valve 400 also begins to be turned, and then the passing hole 430 is rotated in the movement direction of the nib 111, such that the ball valve 400 is returned to maintain the sealed state (see FIGS. 7 and 9).

FIG. 9 is an enlarged cross-sectional view illustrating a state immediately before the operation cap 500 is manipulated at a position at which the cam protrusion 210 is assembled to the twist cam groove 310 of the tubular operation body 300.

FIG. 10 is an enlarged cross-sectional view illustrating a state in which the tubular operation body 300, the sleeve 200, and the nib 111 provided at the tip of the content cartridge 110 are moved forward by the rotation of the operation cap 500, and the nib 111 is exposed to the outside of the operation cap 500.

FIGS. 11 to 13 illustrate operating states of the operation cap 500, the sleeve 200, and the ball valve 400 in a state in which the operation cap 500 and the housing 100 are cut by about ½.

FIGS. 14 to 16 are perspective views illustrating operating states of the operation cap 500, the sleeve 200, and the ball valve 400 in a state in which only the operation cap 500 and the housing 100 are cut by about ½.

FIGS. 17 and 19 are perspective views and a front view illustrating a position at which the passing hole 430 is closed in a direction perpendicular to the direction in which the nib 111 moves forward in a state in which the arms 330 provided on the tubular operation body 300 are connected to the ball valve 400 in a state immediately before the arms 330 move forward.

FIGS. 18 and 20 are a perspective view and a front view illustrating a position at which the passing hole 430 is opened in a straight line with respect to the direction in which the nib 111 moves forward in the state in which the arms 330 provided on the tubular operation body 300 are connected to the ball valve 400 in the state in which the arms 330 is moved forward.

The arms 330 moves upward or downward while moving forward or rearward to turn the eccentric pins 420.

Meanwhile, a plurality of O-rings may be installed at the periphery of the rotary components to prevent the nib 111 from being dried or prevent volatile contents from being evaporated.

Further, the support ring 460 connected to the ball valve 400 is consistently pressed by the spring 460, and thus the ball valve 400 is in close contact with the ball seat 440, such that a gap is prevented from being formed at the periphery of the ball valve 400, thereby maintaining an effect of perfectly sealing the inside of the housing 100 for a long period of time.

According to the dual twist structure, the object ejecting device including the same, and the structure for sealing the same according to the present disclosure configured as described above, the content cartridge 110 may be applied to a writing instrument for storing volatile ink and preventing the ink from being dried, for example.

In addition, it is possible to prevent contents, such as stick cosmetics which may be discolored or degenerated, from being discolored or degenerated, and to maintain cleanliness for a long period of time.

A fixing unit 600 is provided on at least any one of an end of the cam groove 120 and an end of the twist cam groove 310.

According to the embodiment of the present disclosure, as illustrated in FIG. 21A, the fixing unit 600 may be provided at the end of the cam groove 120.

In this case, the fixing unit 600 includes a first stopper 610 formed to be convex toward the inside of the cam groove 120 and disposed on at least one of one end and two opposite ends of the cam groove 120.

The first stopper 610 is formed to be convex toward the inside of the cam groove 120, i.e., toward a centerline in the cam groove 120. When a predetermined pressure is further applied after the cam pin 320 approaches the first stopper 610, the cam pin 320 is resiliently fitted with and coupled to the first stopper 610.

In this case, the first stopper 610 may be convexly formed only at one side or two opposite sides toward the centerline in the cam groove 120. The cross-sectional shape of the first stopper 610 may be a streamlined shape or an angled shape.

That is, the fixing unit 600 restricts a movement of the cam pin 320 after the cam pin 320 moves along the cam groove 120 and is fitted with and coupled to the first stopper 610, such that it is possible to prevent the rotation of the operation cap 500 and allow the user to recognize the rotation of the operation cap 500 and easily check whether the object ejecting device is sealed.

In addition, as illustrated in FIG. 21B, the fixing unit 600 may be provided at the end of the twist cam groove 310.

In this case, the fixing unit 600 includes a second stopper 620 formed to be convex toward the inside of the twist cam groove 310 and disposed on at least one of one end and two opposite ends of the twist cam groove 310.

The second stopper 620 is formed to be convex toward the inside of the twist cam groove 310, i.e., toward a centerline in the twist cam groove 310. When a predetermined pressure is further applied after the cam protrusion 210 approaches the second stopper 620, the cam protrusion 210 is resiliently fitted with and coupled to the second stopper 620.

In this case, the second stopper 620 may be convexly formed only at one side or two opposite sides toward the centerline in the twist cam groove 310. The cross-sectional shape of the second stopper 620 may be a streamlined shape or an angled shape.

That is, the fixing unit 600 restricts a movement of the cam protrusion 210 after the cam protrusion 210 moves along the twist cam groove 310 and is fitted with and coupled to the second stopper 620, such that it is possible to prevent the rotation of the operation cap 500 and allow the user to recognize the rotation of the operation cap 500 and easily check whether the object ejecting device is sealed.

According to still another embodiment of the present disclosure, as illustrated in FIG. 22A, the fixing unit 600 may be provided at the end of the cam groove 120.

In this case, the fixing unit 600 includes a first magnet 630 disposed on at least one of one end and two opposite ends of the cam groove 120.

The first magnet 630 may be attached to or embedded in at least one of one end and two opposite ends of the cam groove 120. The first magnet 630 is made of a material for providing a magnetic force, such that when the cam pin 320 approaches the first magnet 630, the cam pin 320 is coupled to the first magnet 630 by the magnetic force.

That is, the fixing unit 600 may restrict the movement of the cam pin 320 by means of the magnetic force of the first magnet 630 when the cam pin 320 moves along the cam groove 120. Therefore, it is possible to prevent the rotation of the operation cap 500 and allow the user to recognize the rotation of the operation cap 500 and easily check whether the object ejecting device is sealed.

In addition, as illustrated in FIG. 22B, the fixing unit 600 may be provided at the end of the twist cam groove 310.

In this case, the fixing unit 600 includes a second magnet 640 disposed on at least one of one end and two opposite ends of the twist cam groove 310.

The second magnet 640 may be attached to or embedded in at least one of one end and two opposite ends of the twist cam groove 310. The second magnet 640 is made of a material for providing a magnetic force, such that when the cam protrusion 210 approaches the second magnet 640, the cam protrusion 210 is coupled to the second magnet 640 by the magnetic force.

That is, the fixing unit 600 may restrict the movement of the cam protrusion 210 by means of the magnetic force of the second magnet 640 when the cam protrusion 210 moves along the twist cam groove 310. Therefore, it is possible to prevent the rotation of the operation cap 500 and allow the user to recognize the rotation of the operation cap 500 and easily check whether the object ejecting device is sealed.

The exemplary embodiments disclosed in the present specification and the configurations illustrated in the drawings are just the best preferred exemplary embodiments of the present disclosure and do not represent all the technical spirit of the present disclosure. Accordingly, it should be appreciated that various equivalents and modified examples capable of substituting the exemplary embodiments may be made at the time of filing the present application.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A dual twist structure comprising:

a housing (100) including a content cartridge (110) therein and having a cam groove (120) provided at a tip thereof;

a sleeve (200) coupled to and fitted with the content cartridge (110) and having a cam protrusion (210) formed on an outer portion thereof; and a tubular operation body (300) having a twist cam groove (310) into which the cam protrusion (210) is slidably fitted, and a cam pin (320) protruding and configured to move the tubular operation body (300) to a position misaligned with the twist cam groove (310) by being guided by the cam groove (120), wherein the dual twist structure has the two cam grooves, and wherein the cam groove (120) comprises an inclined portion (121) and a straight portion (122) which are capable of adjusting a movement time and a movement distance, the twist cam groove (310) comprises a straight portion (311) and an inclined portion (312) which are capable of adjusting a movement time and a movement distance, and motion distances of the sleeve (200) and the content cartridge (110) vary depending on inclination angles of the inclined portion (121) and the inclined portion (312).

2. The dual twist structure of claim 1, wherein the content cartridge (110) and the sleeve (200) are integrated.

3. The dual twist structure of claim 1, wherein a guide groove and a guide protrusion are respectively provided on the housing and the cartridge so as to correspond to each other, and the housing and the cartridge are in contact with each other and move by means of the guide groove and the guide protrusion.

4. An object ejecting device comprising:

the dual twist structure according to claim 1; and an operation cap (500) rotatably coupled to a tip of the housing (100) and having a guide groove (510) into which the cam pin (320) of the tubular operation body (300) is slidably fitted.

5. The object ejecting device of claim 4, further comprising:

a fixing unit (600) provided at one or both of an end of the cam groove (120) and an end of the twist cam groove (310), wherein the fixing unit (600) comprises a first stopper (610) formed to be convex toward the inside of the cam groove (120) and disposed on at least one of one end and two opposite ends of the cam groove (120), and restricts a movement of the cam pin (320) after the cam pin (320) moves along the cam groove (120) and is fitted with and coupled to the first stopper (610), wherein the fixing unit (600) comprises a second stopper (620) formed to be convex toward the inside of the twist cam groove (310) and disposed on at least one of one end and two opposite ends of the twist cam groove (310), and restricts a movement of the cam protrusion (210) after the cam protrusion (210) moves along the twist cam groove (310) and is fitted with and coupled to the second stopper (620).

6. The object ejecting device of claim 4, wherein the fixing unit (600) comprises a first magnet (630) disposed on at least one of one end and two opposite ends of the cam groove (120), and restricts a movement of the cam pin (320) by means of a magnetic force of the first magnet (630) when the cam pin (320) moves along the cam groove (120).

7. The object ejecting device of claim 6, wherein the fixing unit (600) comprises a second magnet (640) disposed on at least one of one end and two opposite ends of the twist cam groove (310), and restricts a movement of the cam protrusion (210) by means of a magnetic force of the second magnet (640) when the cam protrusion (210) moves along the twist cam groove (310).

8. A structure for sealing an object ejecting device, the structure comprising:

the object ejecting device according claim 1; and a ball valve (400) having a ball shape and comprising:

center pins (410) protruding outward from a center position thereof; and eccentric pins (420) protruding from eccentric positions spaced apart from the center pins (410) at a distance and configured to be fitted and assembled with shaft holes (331) of arms (330), wherein the ball valve (400) opens or closes a passageway by controlling a position of a passing hole (430) when the tubular operation body (300) simultaneously rotates in a twist direction and moves forward or rearward by being guided by the cam groove (120).

9. The structure of claim 8, wherein a ball seat (440) configured to support a rotation of the ball valve (400) is installed in a tip portion of the operation cap (500), and a support ring (450) is installed at a position of an installation part (530) of the operation cap (500) so that the center pins (410) of the ball valve (400) are fitted into the pin holes (451), and the ball valve (400) is turned about the center pins (410).

10. The structure of claim 9, wherein the support ring (450) is manufactured integrally with the operation cap (500).

11. The structure of claim 10, wherein the spring (460) is manufactured integrally with a tip of the housing (100).

12. The structure of claim 8, wherein a spring (460) configured to maintain a pressing force on the ball valve (400) is installed between the support ring (450) and the housing (100).

13. The structure of claim 8, wherein a notch groove (332) is recessed at one end of the arm (330) so that the arm (330) is freely bent.

* * * * *